US011236538B2

(12) United States Patent
Kalb et al.

(10) Patent No.: US 11,236,538 B2
(45) Date of Patent: Feb. 1, 2022

(54) ACOUSTICALLY DECOUPLED DRIVE DEVICE FOR A WINDOW LIFTER

(71) Applicant: BROSE FAHRZEUGTEILE GMBH & CO. KOMMANDITGESELLSCHAFT, BAMBERG, Bamberg (DE)

(72) Inventors: Roland Kalb, Rossach (DE); Gabriele Lange, Marktrodach (DE)

(73) Assignee: Brose Fahrzeugteile GmbH & Co. Kommanditgesellschaft, Bamberg, Bamberg (DE)

( * ) Notice: Subject to any disclaimer, the term of this patent is extended or adjusted under 35 U.S.C. 154(b) by 231 days.

(21) Appl. No.: 16/331,110

(22) PCT Filed: Sep. 5, 2017

(86) PCT No.: PCT/EP2017/072205

§ 371 (c)(1),
(2) Date: Mar. 6, 2019

(87) PCT Pub. No.: WO2018/046483

PCT Pub. Date: Mar. 15, 2018

(65) Prior Publication Data

US 2019/0234130 A1 Aug. 1, 2019

(30) Foreign Application Priority Data

Sep. 6, 2016 (DE) ..... 102016216884.3

(51) Int. Cl.
*E05F 11/00* (2006.01)
*E05F 15/697* (2015.01)

(52) U.S. Cl.
CPC ..... *E05F 15/697* (2015.01); *E05Y 2201/10* (2013.01); *E05Y 2900/55* (2013.01)

(58) Field of Classification Search
CPC ..... E05F 11/483; E05F 11/50; E05F 15/697; E05F 15/689; E05Y 2900/55;
(Continued)

(56) References Cited

U.S. PATENT DOCUMENTS 5,875,588 A * 3/1999 Torii ..... H02K 7/1166 49/349
5,890,321 A * 4/1999 Staser ..... E05F 15/697 49/502

(Continued)

FOREIGN PATENT DOCUMENTS

CN 2828273 Y 10/2006
CN 101649884 A 2/2010

(Continued)

*Primary Examiner* — Chi Q Nguyen
(74) *Attorney, Agent, or Firm* — Brooks Kushman P.C.

(57) ABSTRACT

A drive apparatus for an adjusting device for adjusting a vehicle part, in particular a window lifter, comprising a carrier element, a transmission element which can be driven by means of a motor unit, and a drive housing which is arranged on the carrier element and which has a bearing element for rotatably bearing the transmission element about an axis of rotation. The carrier element has at least one first positive-locking element and the drive housing has at least one second positive-locking element, which are in engagement with one another for a rotation-preventing securing action, wherein an elastic dampening element is arranged between the at least one first positive-locking element and the at least one second positive-locking.

16 Claims, 14 Drawing Sheets

(58) Field of Classification Search
CPC ..... E05Y 2201/10; E05Y 2600/51; E05Y 2201/664; E05Y 2600/636; H02K 5/22
USPC ..... 49/502, 350, 324, 348, 349, 140, 353, 49/352; 310/83, 98, 99
See application file for complete search history.

(56) References Cited

U.S. PATENT DOCUMENTS

| | | | | |
|---|---|---|---|---|
| 6,574,922 | B2 * | 6/2003 | Velthaus | E05F 15/689 296/146.7 |
| 9,151,102 | B2 * | 10/2015 | Debus | E05F 7/00 |
| 9,580,953 | B1 * | 2/2017 | Matsushita | B60J 1/08 |
| 2003/0160124 | A1 | 8/2003 | Hemond et al. | |
| 2005/0016069 | A1 * | 1/2005 | Doux | E05F 15/697 49/352 |
| 2007/0034304 | A1 * | 2/2007 | Inoue | F16H 55/06 148/561 |
| 2007/0049453 | A1 * | 3/2007 | Nagai | F16H 3/54 475/254 |
| 2007/0163179 | A1 * | 7/2007 | Fukumura | H02K 7/116 49/360 |
| 2008/0127565 | A1 * | 6/2008 | Taylor | E05D 5/06 49/394 |
| 2008/0223164 | A1 * | 9/2008 | Greulich | F16H 57/021 74/425 |
| 2016/0036287 | A1 | 2/2016 | Hazel et al. | |
| 2017/0335929 | A1 * | 11/2017 | Makino | F16H 1/08 |
| 2019/0203519 | A1 * | 7/2019 | Kalb | E05F 11/488 |

FOREIGN PATENT DOCUMENTS

| | | | |
|---|---|---|---|
| CN | 202012578 | U | 10/2011 |
| CN | 102575496 | A | 7/2012 |
| DE | 10011236 | A1 | 9/2001 |
| DE | 10328894 | A1 | 1/2005 |
| DE | 102004026065 | A1 | 12/2005 |
| DE | 102004044863 | A1 | 3/2006 |
| DE | 102007028383 | A1 | 12/2008 |
| DE | 102009039406 | A1 | 3/2011 |
| DE | 202010002222 | U1 | 6/2011 |
| EP | 577460 | B1 | 5/1996 |
| EP | 2320541 | A1 | 5/2011 |
| FR | 2743118 | A1 | 7/1997 |
| JP | H03228987 | A | 10/1991 |
| JP | 2012077527 | A | 4/2012 |
| JP | 5981132 | B2 | 8/2016 |
| WO | 2015156355 | A1 | 10/2015 |

* cited by examiner

ACOUSTICALLY DECOUPLED DRIVE DEVICE FOR A WINDOW LIFTER

CROSS-REFERENCE TO RELATED APPLICATIONS

This application is the U.S. National Phase of PCT Application No. PCT/EP2017/072205, filed on Sep. 5, 2017, which claims priority to German Patent Application No. 10 2016 216 884.3, filed on Sep. 6, 2016, the disclosures of which are incorporated in their entirety by reference herein.

TECHNICAL FIELD

The disclosure relates to a drive apparatus for an adjusting device for adjusting a vehicle part, in particular a window lifter.

BACKGROUND

Vehicles may include one or more drive devices to adjust a vehicle part. A drive apparatus of said type may include a carrier element, a transmission element, for example a drive gear, which can be driven by means of a motor unit, and a drive housing which is arranged on the carrier element and which has a bearing element for rotatably bearing the transmission element about an axis of rotation.

A drive apparatus of said type may in particular be a constituent part of a window lifter device, and thus serve for adjusting a window pane. A drive apparatus of said type may however also serve for adjusting some other adjustable element, for example a cover element in the form of a sliding roof or the like, in a vehicle.

In the case of a window lifter, it is for example possible for one or more guide rails to be arranged on an assembly carrier of a door module, on which guide rails there is guided in each case one driver which is coupled to a window pane. The driver is for example coupled by means of a flexible traction cable, which is designed for transmitting (exclusively) tensile forces, to the drive apparatus, wherein the traction cable is arranged on the cable drum such that, during a rotational movement of the cable drum, the traction cable is, with one end, wound onto the cable drum and is, with another end, unwound from the cable drum. A displacement of a cable loop formed by the traction cable thus occurs, together with a corresponding movement of the driver along the respectively associated guide rail. Driven by the drive apparatus, the window pane can thus be adjusted, for example in order to open or close a window opening on a vehicle side door.

SUMMARY

It is an object underlying the proposed solution to provide a drive apparatus which is in particular easy to assemble and which can have expedient operating characteristics during operation.

One or more objects may be achieved by subject matter having features as described herein.

Accordingly, the carrier element has at least one first positive-locking element and the drive housing has at least one second positive-locking element, which are in engagement with one another for a rotation-preventing securing action, wherein an elastic dampening element is arranged between the at least one first positive-locking element and the at least one second positive-locking element and acts such that the first positive-locking element and the second positive-locking element are supported in damped fashion relative to one another along at least one spatial direction via the elastic dampening element in a first load state, but come into contact with one another in a second load state which is increased in relation to the first load state.

The drive housing is held on the carrier element, for example an assembly carrier of a door module, for example by a central fastening element which produces a fastening via the bearing element which bears the transmission element. The fastening of the drive housing to the carrier element can thus be produced by one (single) or more central fastening elements, for example a screw element, such that simple assembly can be realized.

In order, in the case of such a central fastening by a fastening element, to produce a rotation-preventing securing action, a rotation-preventing securing device is provided which is designed to intercept and dissipate torques acting between the drive housing and the carrier element. The rotation-preventing securing device, may ensure that the drive housing is held on the carrier element so as to be rotationally fixed about the axis of rotation.

Here, in order to at least reduce an excitation of vibrations of the carrier element via the drive housing, the rotation-preventing securing device has an elastic dampening element which acts between the drive housing and the carrier element. The rotation-preventing securing action may thus realized by an elastic dampening element which elastically dampens a transition between the drive housing and the carrier element, such that no vibration excitation, or at least only a reduced vibration excitation, can occur on the carrier element via the rotation-preventing securing device.

The rotation-preventing securing device is formed by the at least one first positive-locking element of the carrier element and the at least one second positive-locking element of the drive housing. The positive-locking elements are spaced apart from the axis of rotation and thus suitable, by way of their engagement into one another, for accommodating and supporting torques. The elastic dampening element acts between an associated first positive-locking element and an associated second positive-locking element and in this way—at least in a first load state, which may correspond to a state under normal, routine loads—acts with dampening action between the positive-locking elements.

The engagement of the positive-locking elements into one another is however in this case configured such that, in the presence of elevated load—that is to say in a second load state, in which the load is higher than in the first load state—the positive-locking elements come into contact with one another. In this way, an excessive compression of the elastic dampening element can be avoided, which can prevent damage to the elastic dampening element and can lengthen the service life of the elastic dampening element.

One of the positive-locking elements, that is to say the first positive-locking element or the second positive-locking element, that may include a positive-locking pin. For example, the carrier element may have a positive-locking pin of said type, which protrudes from a surface portion of the carrier element. The respective other positive-locking element then has a positive-locking opening, into which the positive-locking pin engages. For example, the second positive-locking element of the drive housing may have a positive-locking opening of said type, with which the positive-locking pin of the carrier element engages.

The rotation-preventing securing device may then act by the engagement of the positive-locking pin on one of the components into the positive-locking opening on the other of the components. A positive-locking pin of said type may for example be arranged on the carrier element and engage into a positive-locking opening on the drive housing. Conversely, it is also possible for a positive-locking pin to be arranged on the drive housing and to engage into a positive-locking opening on the carrier element. The rotation-preventing securing action is thus realized by a positively locking engagement, such that the drive housing is fixed in positively locking fashion with respect to the carrier element in order to accommodate and dissipate torques acting about the axis of rotation.

The engagement between the positive-locking pin and the positive-locking opening occurs at a point radially spaced apart from the axis of rotation, such that torques can be accommodated and dissipated in an effective manner by the engagement. It is preferable here for multiple pairs of positive-locking pins, on the one hand, and positive-locking openings, on the other hand, to be provided, such that the rotation-prevention securing action is provided by an engagement of positive-locking pins into associated positive-locking openings at multiple points about the axis of rotation.

In one embodiment, each positive-locking pin has for example a central, for example cylindrical (pin-shaped) portion on which the elastic dampening element is arranged. Here, the central portion is covered at least in sections by the elastic dampening element, such that the elastic dampening element is situated is in an intermediate position between the central portion of the positive-locking pin and a wall of the positive-locking opening and thus the engagement of the positive-locking pin into the positive-locking opening is acoustically dampened.

The elastic dampening element is may be produced from an elastic material, for example an elastomer or a rubber material. The elastic dampening element has a (considerably) greater elasticity (that is to say lower stiffness) than in particular the carrier element and the drive housing, which are for example also manufactured from plastic but have a rigid structure.

In one embodiment, the positive-locking pin may have a cheek portion, for example in the form of a pin, which protrudes radially from the central portion and which extends parallel to the axis of rotation on the central portion. The cheek portion is adjacent to an elastic web of the elastic dampening element, that may protrude radially outward with respect to the cheek portion and bears against a shell surface which circumferentially surrounds the positive-locking opening, such that the positive-locking pin is supported in a radial direction within the positive-locking opening via the elastic web. The transition between the positive-locking pin and the shell surface surrounding the positive-locking opening is thus dampened, such that vibrations can be transmitted only in a damped manner from the drive housing to the carrier element.

The positive-locking pin may include multiple cheek portions which are distributed circumferentially about the central portion, whereas the elastic dampening element has multiple webs which engage between the cheek portions. Each cheek portion is received between a pair of webs, such that each positive-locking pin is, via elastic webs which are distributed around the central portion, supported radially with respect to the shell surface surrounding the positive-locking opening. In this way, dampening in a plane perpendicular to the axis of rotation is provided, such that both forces and moments acting translationally and rotationally may be intercepted, dissipated and dampened.

Via the at least one cheek portion, an excessive compression of the elastic dampening element can be prevented in that, in the event of excessively intense vibrations on the drive housing, the positive-locking pin comes into contact by way of the cheek portion with the shell surface on the fastening device which forms the positive-locking opening. Play may exist between the cheek portions of the positive-locking pin and the inner circumferential shell surface of the positive-locking opening, and the elastic support of the positive-locking pin in the positive-locking opening via the webs of the elastic dampening element, dampening of the vibration excitation on the carrier element is realized, wherein the maximum compression of the elastic dampening element is predefined by the play. In the presence of intense vibrations (in the second load state) which lead to a relative movement of the positive-locking pin in the positive-locking opening which exceeds the play, at least one of the cheek portions makes contact with the shell surface, such that a further compression of the elastic dampening element is prevented. This makes it possible for an (excessive) impairment of the elastic characteristics of the elastic dampening element over the service life of the drive apparatus to be avoided, such that the dampening characteristics are maintained over the service life of the drive apparatus.

The elastic dampening element may include a head portion which at least partially overlaps the central portion at a face surface extending transversely with respect to the axis of rotation. If the positive-locking pin is arranged for example on a surface portion of the carrier element and the central portion protrudes from the surface portion, then the elastic dampening element, by way of its head portion, overlaps the central portion at the face surface averted from the surface portion. In an axial direction, the elastic dampening element thus assumes an intermediate position between the positive-locking pin and a base of the positive-locking opening. Additionally, a spacer element, for example, in the form of a stud or the like may be arranged on the head portion, and a spacer element may provide tolerance compensation between the positive-locking pin and the base of the positive-locking opening can be realized.

In particular, a tolerance compensation between the cheek portions of the positive-locking pin and the base of the positive-locking opening, and also an elastic play in an axial direction, can be predefined by the spacer element.

In one embodiment, the at least one elastic dampening element may be formed in one piece with a sealing ring of a sealing element. The sealing ring serves for sealing off a transition between the drive housing and the carrier element in moisture-tight fashion, wherein the elastic dampening elements are connected for example via tabs to the sealing ring in order to form a unitary sealing element. The sealing element may be formed of an elastic, compressible material, for example an elastomer or a rubber material.

The dampening element may however be formed separately from a seal.

In one specific embodiment, the drive apparatus has a cable drum and a cable exit housing arranged on a side, averted from the drive housing, of the carrier element. The cable exit housing forms a bearing element for rotatably bearing the cable drum about the axis of rotation, such that the cable drum is held rotatably on the carrier element by the cable exit housing.

Provision may be made here whereby the fastening element acts between the bearing element of the cable exit housing and the bearing element of the drive housing, for example by virtue of the fastening element being screwed from one bearing element into the other bearing element and the cable exit housing being braced relative to the drive housing in this way. The drive housing may be fixed by the cable exit housing to the carrier element, wherein the rotation-preventing securing device which acts with dampening action serves for accommodating torques on the drive housing.

The bearing element of the cable exit housing, on which the cable drum is rotatably borne, and the bearing element of the drive housing, on which the transmission element is rotatably borne, may be arranged coaxially with respect to one another such that the bearing elements define a common axis of rotation for the cable drum and the transmission element.

By virtue of the fact that the cable exit housing on the one, first side of the carrier element and the drive housing on the other, second side of the carrier element are fastened to one another, and thus fixed to the carrier element, by one (single) or more fastening elements, that may act as the bearing elements, very simple assembly is realized. In particular, for the assembly process, the cable exit housing can be mounted on one side and the drive housing can be mounted on the other side onto the carrier element, in order for the cable exit housing and the drive housing to then be connected to one another, and may be braced axially relative to one another, by the fastening element, for example a screw element.

Here, the fastening element may engage from one of the bearing elements into the other of the bearing elements and thereby connect the bearing elements to one another. The cable exit housing on one side and the drive housing on the other side may be fixed to one another by the bearing elements.

In an operational arrangement in a vehicle, the cable drum is arranged for example on a vehicle side door, for example in a wet space, whereas the motor unit of the drive apparatus is situated in a dry space. The separation between the wet space and the dry space may be provided here by the carrier element, for example an assembly carrier, produced from plastic, of a door module. The mounting of the cable exit housing on one side of the carrier element and the drive housing on the other side of the carrier element and the connection by a central fastening element, may provide a wet-dry space separation of this type in a simple manner without this wet-dry space separation being impaired by fastening elements which engage from one side to the other side.

The bearing element for bearing the cable drum may for example be formed as a cylindrical bearing dome, which protrudes from a base of the cable exit housing. Furthermore, the bearing element of the drive housing, which serves for bearing the transmission element on that side of the carrier element which is averted from the cable drum, may be formed as a cylindrical bearing dome on the drive housing. The bearing domes may be braced axially relative to one another such that by the fastening element, in this way, the cable exit housing on one side and the drive housing on the other side are fixed to the carrier element.

The fastening element may act between the bearing element of the cable exit housing and the bearing element of the drive housing, the cable exit housing and the drive housing—with the interposition of the carrier element—are fixed axially relative to one another and, by being braced relative to one another, are fastened to the carrier element. Via the cable drum borne on the cable exit housing, it is possible here for torques to act on the cable exit housing, whereas, via the transmission element mounted on the bearing element of the drive housing, it is also possible for torques to act on the drive housing. It may be ensured that the cable exit housing, like the drive housing, cannot move rotationally relative to the carrier element and relative to one another during the operation of the drive apparatus. A rotation-prevention securing action may therefore (also) be provided between the cable exit housing and the carrier element, on one side, and the drive housing and the carrier element, on the other side.

For this purpose, it is for example possible for the at least one housing portion of the base of the cable exit housing may be connected to the carrier element to be fixed in a rotationally fixed manner to the carrier element. Accordingly, on a foot portion of the at least one housing portion or on the carrier element, there may be provided a positive-locking element which, when the cable exit housing has been mounted, engages with a positive-locking opening on the respective other component (that is to say the carrier element or the foot portion of the at least one housing portion). The engagement of the positive-locking element into the positive-locking opening, may provide a rotation-preventing securing action between the cable exit housing and the carrier element. By virtue of the fact that the at least one housing portion is spaced apart radially from the bearing element of the cable exit housing and thus acts radially outside the axis of rotation about which the cable drum is rotatable, it is possible for torques to be intercepted in an expedient manner.

The cable exit housing, such as at least one housing portion may be supported axially on the carrier element and—by axial bracing of the cable exit housing with the drive housing—also braced relative to the carrier element. The bracing force of the fastening element is supported via the at least one housing portion on the carrier element.

Both the cable exit housing and the drive housing can thus be secured in positively locking, rotationally fixed fashion to the carrier element. This positive locking is produced automatically when the cable exit housing is mounted onto one side of the carrier element and when the drive housing is mounted onto the other side of the carrier element, without separate assembly steps being necessary for this purpose and without the need for further fastening elements, for example in the form of screw elements, to be attached. The (axial) fixing of the cable exit housing and of the drive housing to one another may be realized by one or more fastening elements, that may act centrally between the bearing elements of the cable exit housing and of the drive housing.

BRIEF DESCRIPTION OF THE DRAWINGS

The concept on which the solution is based will be discussed in more detail below on the basis of the exemplary embodiments illustrated in figures.

DETAILED DESCRIPTION

A drive apparatus of said type may be generally be configured to provide a sufficiently high torque for adjusting the window pane. It is the intention here for the drive apparatus to be able to have a small structural space, to be able to be mounted easily for example on an associated carrier element, for example the assembly carrier of a door module, and to have, during operation, expedient operating characteristics with little noise generation for example on a door module of a vehicle door.

In the case of a drive known from DE 10 2004 044 863 A1 for an adjusting device in a motor vehicle, a cable drum is arranged on a bearing dome of a drive housing, wherein the drive housing is connected by means of a fastening element in the form of a screw to a carrier element in the form of an assembly carrier.

In the case of a drive apparatus of the type described here, an electric drive is arranged, via the drive housing, on the carrier element, for example an assembly carrier of a door module. Here, the electric drive should be fixed on the carrier element such that, during operation, torques can be transmitted into the cable drum, and via the latter into the adjustable part to be adjusted, in an effective manner. For this purpose, the drive should be fastened in a rotationally fixed manner to the carrier element. In particular, it is necessary for torques, which (also) act between the drive and the carrier element, to be intercepted and dissipated in an effective manner.

During operation, vibration excitation may occur at the drive, which can lead to an acoustic excitation of components for example of a door module.

To prevent excessive noise generation during the operation of the drive apparatus, it must therefore be ensured that vibration-exciting components, in particular the electric drive, are acoustically decoupled from structures and components that can be excited to vibrate, and thus no vibration excitation, or at least only reduced vibration excitation, can occur during operation on a door module or on some other assembly on which the drive apparatus is arranged. In this context, it is in particular desirable for the electric drive to be acoustically decoupled from the carrier element on which the drive is arranged.

Furthermore, however, it is also the intention for the drive apparatus to be able to be assembled easily in a small number of assembly steps, and for a carrier element to be producible inexpensively.

FIGS. 1A, 1B to 18A-18C show an exemplary embodiment of a drive apparatus 1, which may be used for example as a drive in an adjusting device for adjusting a window pane, for example of a vehicle side door.

Figure 19:
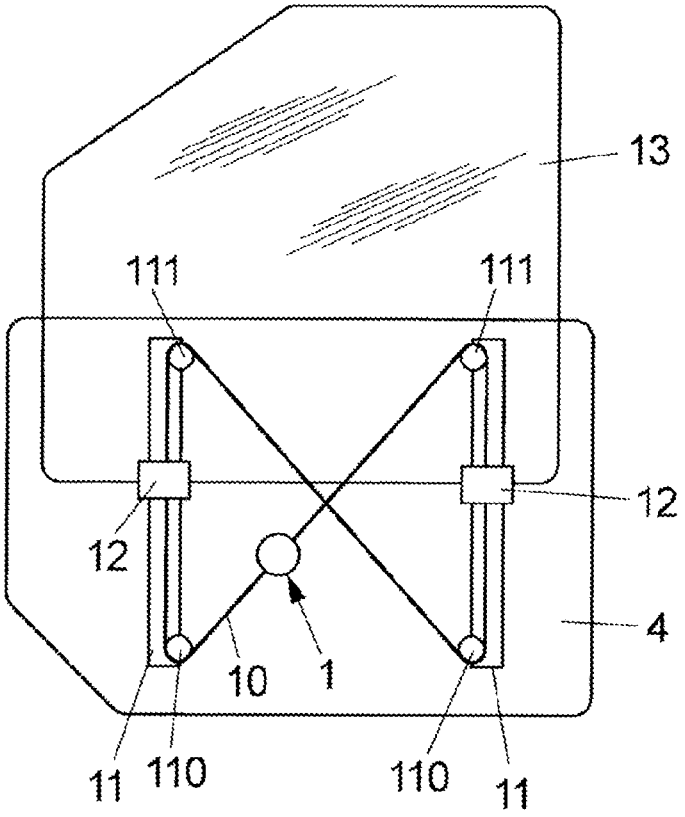
FIG. 19 shows a schematic view of an adjusting device of a vehicle in the form of a window lifter.

An adjusting device of said type in the form of a window lifter, illustrated by way of example in FIG. 19, has for example a pair of guide rails 11, on which in each case one driver 12, which is coupled to a window pane 13, is adjustable. Each driver 12 is coupled by means of a traction cable 10, which is designed for transmitting (exclusively) tensile forces, to a drive apparatus 1, wherein the traction cable 10 forms a closed cable loop and, for this purpose, is connected by way of its ends to a cable drum 3 (see for example FIGS. 1A and 1B) of the drive apparatus 1. The traction cable 10 extends from the drive apparatus 1, around diverting rollers 110 at the lower ends of the guide rails 11, to the drivers 12, and from the drivers 12, around diverting rollers 111 at the upper ends of the guide rails 11, back to the drive apparatus 1.

During operation, a motor unit of the drive apparatus 1 drives the cable drum 3 such that the traction cable 10 is, with one end, wound onto the cable drum 3 and is, with the other end, unwound from the cable drum 3. The cable loop formed by the traction cable 10 is thus displaced without a change in the freely extending cable length, which has the effect that the drivers 12 are moved in the same direction on the guide rails 11, and the window pane 13 is thus adjusted along the guide rails 11.

In the exemplary embodiment as per FIG. 19, the window lifter is arranged on an assembly carrier 4 of a door module. The assembly carrier 4 may for example be provided for being fixed on a door inner panel of a vehicle door, and constitutes a preassembled unit which, preassembled with the window lifter arranged on the assembly carrier 4, can be mounted on the vehicle door.

The drive apparatus 1 is arranged on a surface portion 40 of a carrier element 4, which is realized for example by an assembly carrier, and said drive apparatus has a cable exit housing 2 arranged on a first side of the carrier element 4 and has a drive housing 7 arranged on a second side, averted from the first side, of the carrier element 4. The cable exit housing 2 serves for bearing the cable drum 3 on the carrier element 4, whereas the drive housing 7 encloses inter alia a transmission element in the form of a drive gear 6, which can be driven by means of a motor unit 8 and which is connected to the cable drum 3 such that the cable drum 3 can be driven by rotation of the drive gear 6.

The cable drum 3 on the first side of the carrier element 4 is, when arranged as intended for example on a vehicle door of a vehicle, arranged in a wet space of the vehicle door. By contrast, the drive housing 7 is situated in the dry space of the vehicle door. The separation between wet space and dry space is produced by means of the carrier element 4, and it is correspondingly necessary for the interface between the drive gear 6 and the cable drum 3 to be sealed off in moisture-tight fashion, such that no moisture can pass from the wet space into the dry space.

The cable exit housing 2 has a base 20, a cylindrical bearing element 22 which protrudes centrally from the base 20 and which is in the form of a bearing dome, and housing portions 21 which are radially spaced apart from the bearing element 22 and which are in the form of housing webs extending parallel to the cylindrical bearing element 22. The cable drum 3 is borne rotatably on the bearing element 22 and, here, is enclosed by the cable exit housing 2 such that the cable drum 3 is held on the carrier element 4.

The cable drum 3 has a body 30 and, on the circumferential shell surface of the body 30, a cable groove 300 which is formed into the body 30 and which serves for receiving the traction cable 10. With an internal gear 31, the cable drum 3 is inserted into an opening 41 of the carrier element 4 and is connected rotationally conjointly to the drive gear 6, such that a rotational movement of the drive gear 6 leads to a rotational movement of the cable drum 3.

The drive housing 7 is mounted, with the interposition of a sealing element 5, onto the other, second side of the carrier element 4, and has a housing pot 70 with a bearing element 72 formed centrally therein, which bearing element is in the form of a cylindrical bearing dome which engages through an opening 62 of the drive gear 6 and thereby rotatably bears the drive gear 6. The housing pot 70 is adjoined by a worm housing 74, in which there is situated a drive worm 81 which is connected rotationally conjointly to a drive shaft 800 of an electric motor 80 of the motor unit 8 and which is in meshing engagement, by means of a worm toothing, with an external toothing 600 of a body 60 of the drive gear 6. The drive shaft 800 is borne, by means of a bearing 82 at its end averted from the electric motor 80, in the worm housing 74. Here, the electric motor 80 is situated in a motor pot 73 of the drive housing 7, which is closed off to the outside by means of a housing cover 75.

The drive housing 7 furthermore has an electronics housing 76 in which a circuit board 760 with control electronics arranged thereon is enclosed. The electronics housing 76 is closed off to the outside by means of a housing plate 761 with a plug connector 762 arranged thereon for the electrical connection of the electronics of the circuit board 760.

The drive gear 6 has, protruding axially from the body 60, a connecting gear 61 with an external toothing 610 formed thereon, which external toothing engages with the internal gear 31 of the cable drum 3 such that an internal toothing 310 of the internal gear 31 (see for example FIG. 1B) is in meshing engagement with the external toothing 610 of the connecting gear 61. In this way, the drive gear 6 and the cable drum 3 are connected rotationally conjointly to one another such that the cable drum 3 is rotatable on the carrier element 4 by driving the drive gear 6.

For the assembly of the drive apparatus 1, the cable exit housing 2 is mounted at one side onto the carrier element 4 and the drive housing 7 is mounted at the other side onto the carrier element 4. The fastening to the carrier element 4 is then performed by virtue of a fastening element 9 in the form of a screw element being inserted into an engagement opening 721 on the bottom side of the drive housing 7 such that the fastening element 9 extends through an opening 720 in the bearing element 72 of the drive housing 7 (see FIG. 9) and engages centrally into an opening 221 within the bearing element 22 of the cable exit housing 2. By means of the fastening element 9, the cable exit housing 2 and the drive housing 7 are braced axially relative to one another on the bearing elements 22, 72 and are thereby fixed to the carrier element 4.

Within the opening 221 of the bearing element 22 of the cable exit housing 2, there may be formed a thread for receiving the fastening element 9. It is however also conceivable and possible for the fastening element 9 to be screwed with self-tapping action into the opening 221.

For the assembly process, the cable exit housing 2 is mounted onto the first side of the carrier element 4, such that the cable exit housing 2 encloses the cable drum 3 and holds the latter on the carrier element 4, as illustrated in FIGS. 2 to 4A, 4B. Here, the cable exit housing 2, with its housing portions 21 spaced apart radially from the bearing element 22, comes into contact by way of foot portions 210 with a contact ring 45 which circumferentially surrounds an opening 41 in the carrier element 4. On the contact ring 45, there are formed axially protruding positive-locking elements 42 in the form of web-like pegs which, during the mounting of the cable exit housing 2 onto the carrier element 4, enter into engagement with positive-locking openings 212 (see FIG. 4B) on the foot portions 210 of the housing portions 21 and thereby realize a rotation-preventing securing action, about the axis of rotation D defined by the bearing element 22, between the cable exit housing 2 and the carrier element 4.

Figure 6:
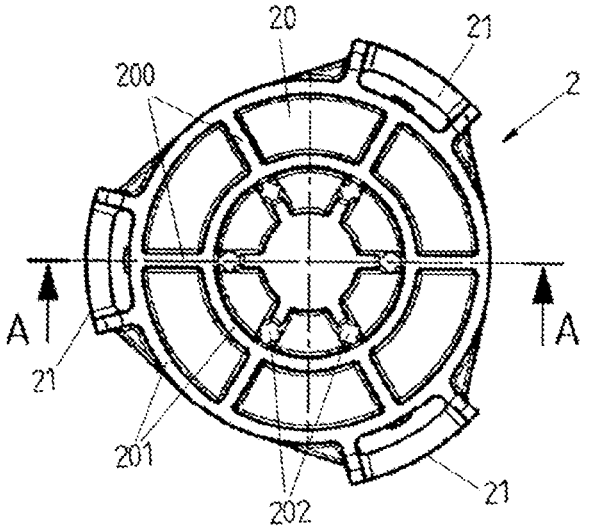
FIG. 6 shows a plan view of the cable exit housing.
Figure 7:
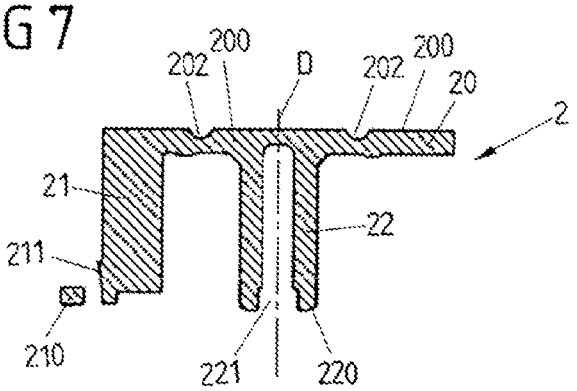
FIG. 7 shows a cross-sectional view along the line A-A as per FIG. 6.
Figure 8:
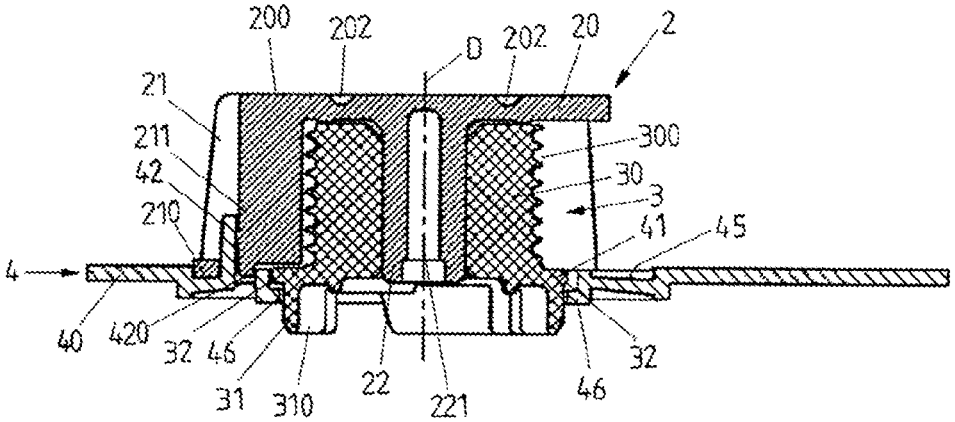
FIG. 8 shows the cross-sectional view as per FIG. 7, with the cable exit housing mounted onto the carrier element.

On the inner side of the positive-locking elements 42, there are formed detent recesses 420 (see for example FIG. 1A) into which detent elements 211 in the form of outwardly protruding detent lugs on the housing portions 21 engage when the cable exit housing 2 is mounted, as can be seen for example when FIGS. 6 to 8 are viewed together. By means of this detent connection, in a preassembly position, the cable exit housing 2 together with the cable drum 3 enclosed therein is held on the carrier element 4 even when the drive housing 7 has not yet been braced with the cable exit housing 2 by means of the fastening element 9. The detent connection thus simplifies the assembly process and prevents the cable exit housing 2 from falling off when the drive housing 7 has not yet been mounted.

In the preassembly position, the cable drum 3 may come to rest by radially protruding rest elements 32 on the upper edge of the internal gear 31 (see for example FIG. 1A) on a rest ring 46 within the opening 41 of the carrier element 4 (see for example FIG. 8), such that the cable drum 3, in the preassembly position, cannot slip through the opening 41 and is held by the cable exit housing 2 on the carrier element 4.

The rest elements 32 serve in particular for securing the position of the cable drum 3 on the carrier element 4 in the preassembly position. After the assembly of the drive apparatus 1 has been completed, the cable drum 3 may be connected by the internal gear 31 to the drive gear 6, and is fixed axially between the cable exit housing 2 and the drive housing 7.

On the inner sides of the housing portions 21, there are arranged axially extending and radially inwardly protruding securing elements 23 which face toward the cable groove 300 on the shell surface of the body 30 and which may slide along said shell surface during operation. The securing elements 23 may ensure that the traction cable 10 received in the cable groove 300 cannot jump out of the cable groove 300.

Figure 1A:
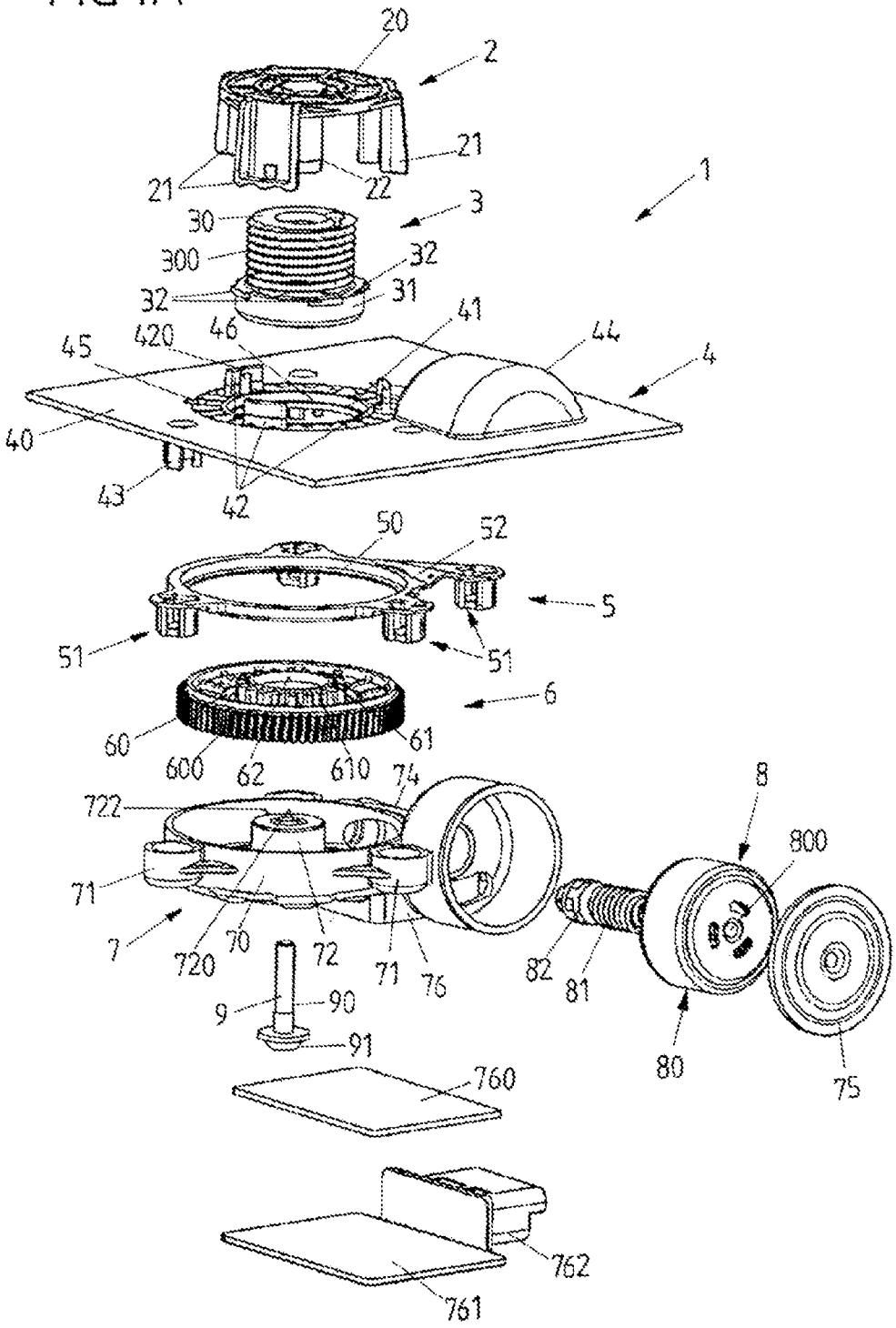
FIG. 1A shows an exploded view of an exemplary embodiment of a drive apparatus.
Figure 1B:
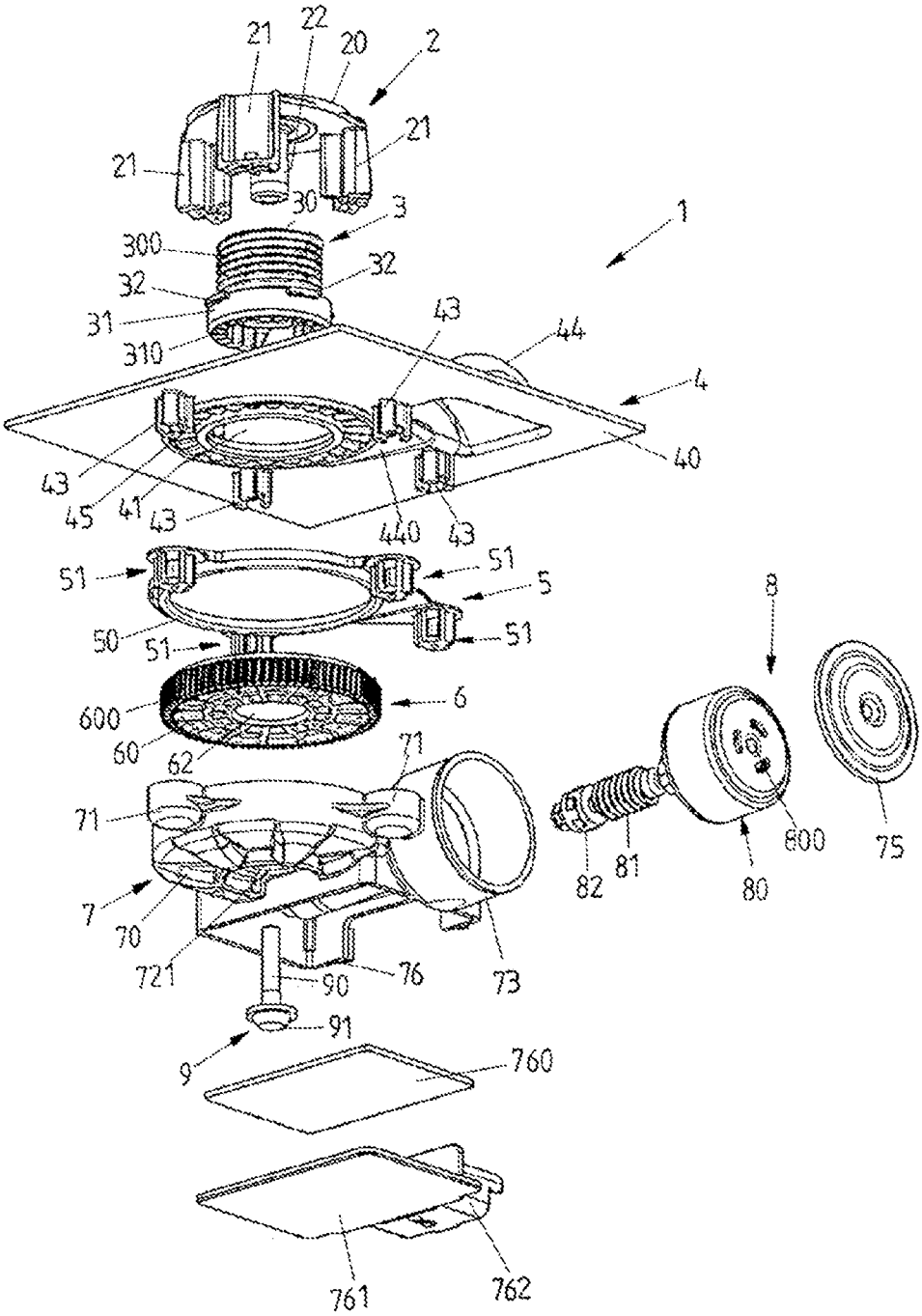
FIG. 1B shows the exploded view as per FIG. 1A, from a different perspective.
Figure 2:
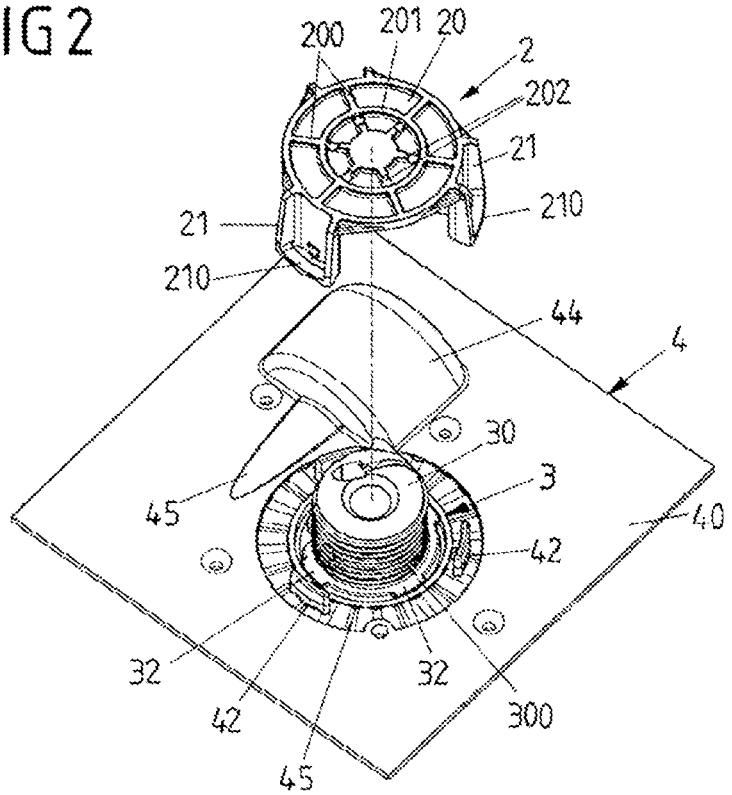
FIG. 2 shows a view of a cable exit housing before mounting onto a carrier element.
Figure 3:
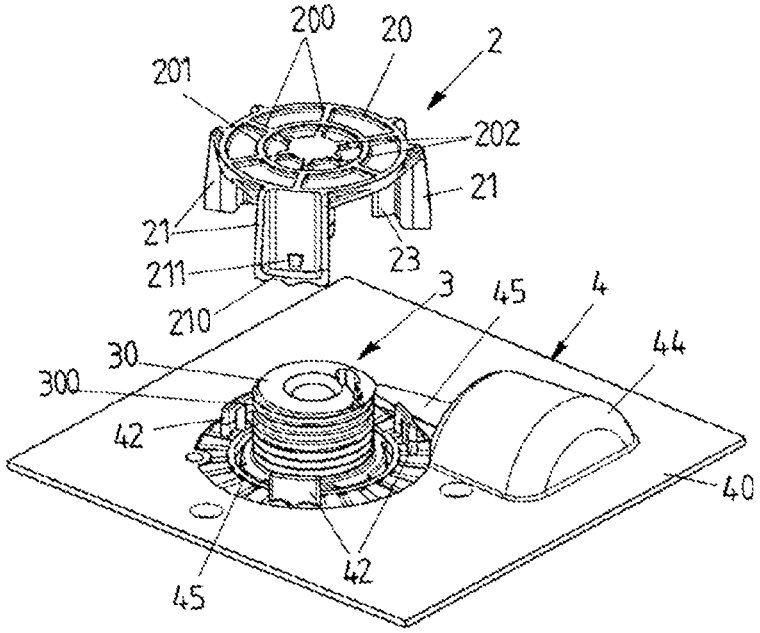
FIG. 3 shows another view of the cable exit housing before mounting onto the carrier element.
Figure 4A:
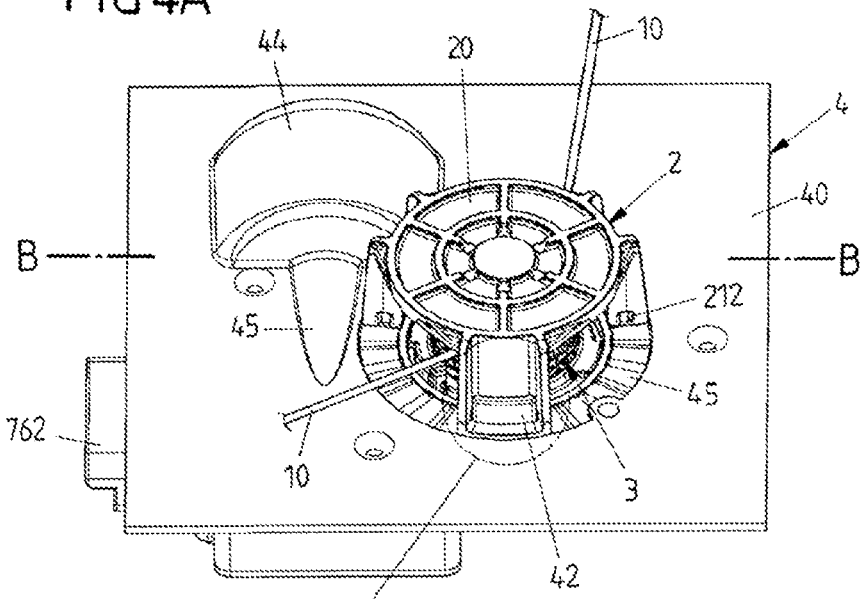
FIG. 4A shows a view of the cable exit housing on the carrier element.
Figure 4B:
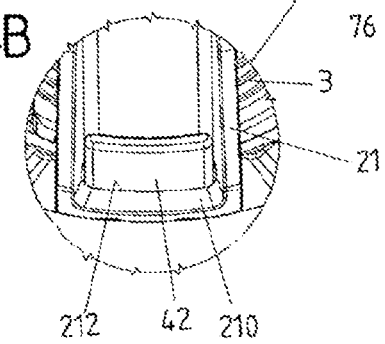
FIG. 4B shows an enlarged detail view of the arrangement as per FIG. 4A.
Figure 5:
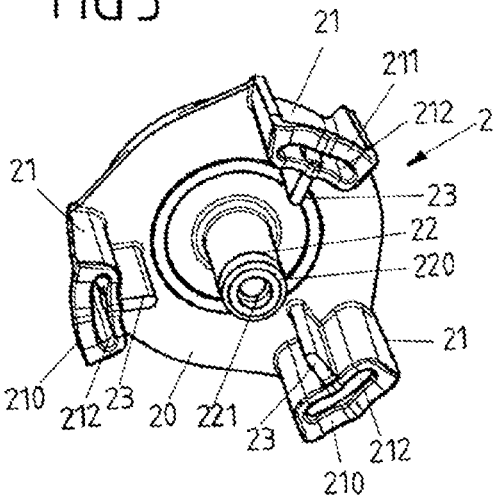
FIG. 5 shows a view of the cable exit housing on its own, obliquely from below.

The drive housing 7 is mounted onto the other, second side of the carrier element 4 such that the motor pot 73 comes to lie in a protuberance 44 in the surface portion 40 and the worm housing 74 comes to lie in a protuberance 440, which adjoins the former protuberance, in the surface portion 40 (see FIGS. 1A, 1B and 2). During the mounting of the drive housing 7, positive-locking elements 71 in the form of engagement bushings with positive-locking openings 710 formed therein enter into engagement with positive-locking elements 43 in the form of positive-locking pegs which protrude at the bottom side from the carrier element 4. By virtue of the fact that the positive-locking openings 710 of the positive-locking elements 71 are spaced apart radially from the axis of rotation D created by the bearing element 72 of the drive housing 7 in exactly the same way as the positive-locking elements 43 on the carrier element 4, this positive-locking engagement causes the drive housing to be fixed in a rotationally fixed manner on the carrier element 4, such that a rotation-prevention securing action is provided for the drive housing 7.

Figure 10:
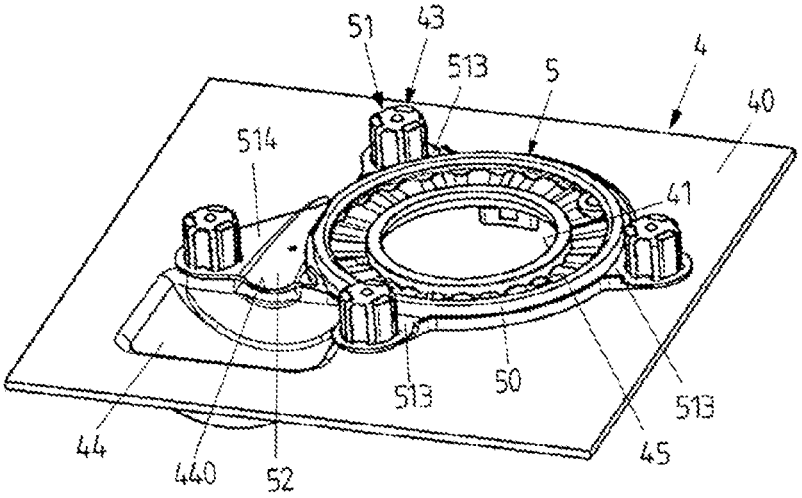
FIG. 10 shows a view of a sealing element on the carrier element.
Figure 11:
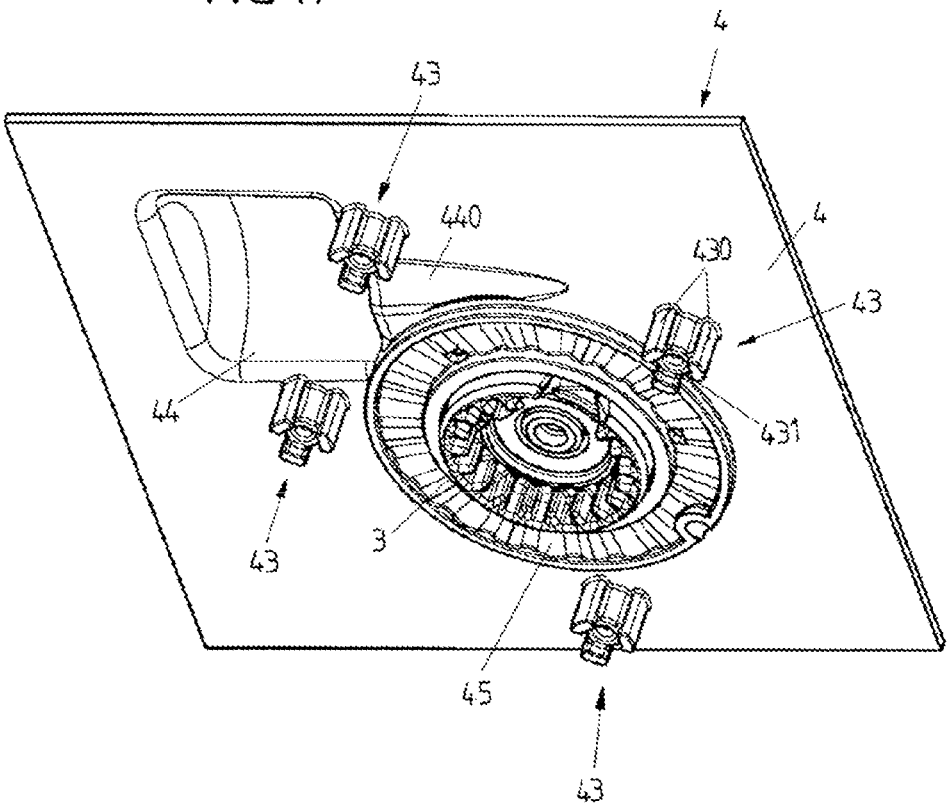
FIG. 11 shows a view of the carrier element on its own.
Figure 12:
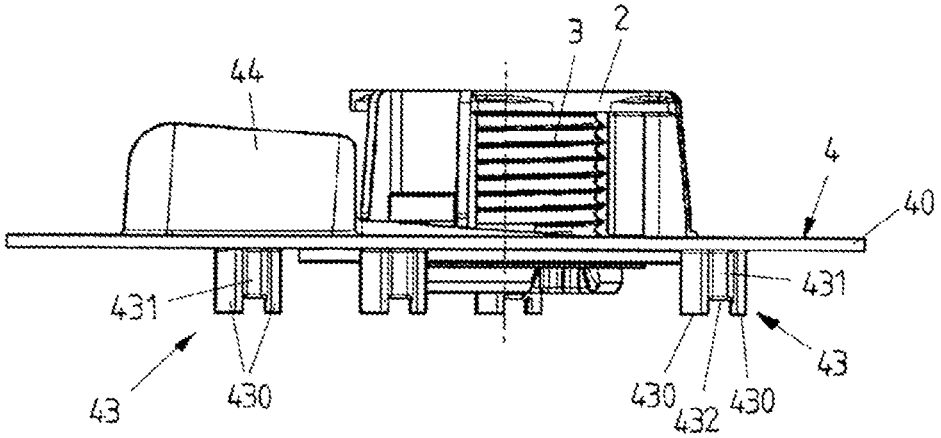
FIG. 12 shows a side view of the carrier element with cable exit housing arranged thereon.
Figure 13A:
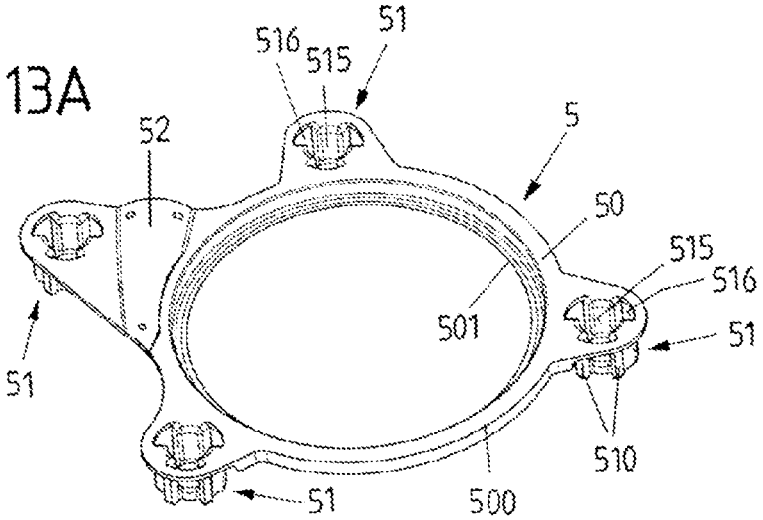
FIG. 13A shows a view of the sealing element on its own.
Figure 13B:
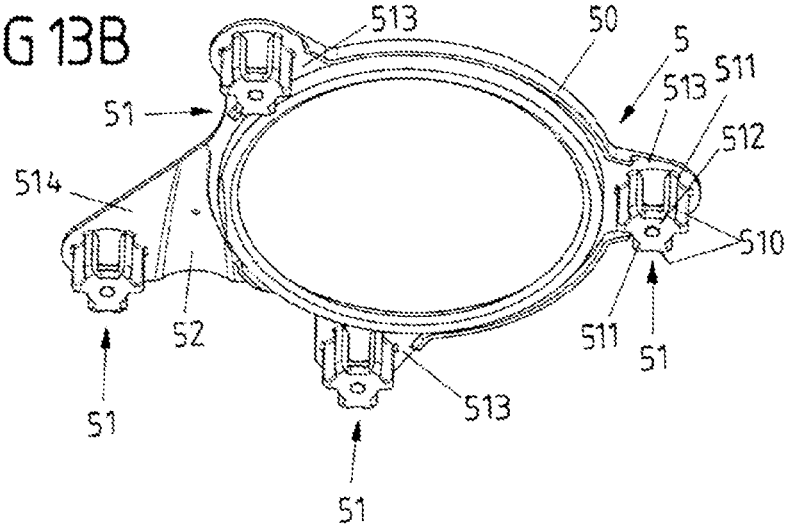
FIG. 13B shows another perspective view of the sealing element.

As can be seen from FIGS. 10 to 12, the positive-locking elements 43 are formed in each case by a central portion 431 in the form of a cylindrical peg, around which there are grouped in each case multiple, in the exemplary embodiment illustrated three, axially extending cheek portions 430, such that intermediate spaces are formed between the cheek portions 430. The cheek portions 430 extend parallel to the axis of rotation D predefined by the bearing element 72, and protrude radially and axially beyond the central portion 431.

As can be seen for example from FIG. 10, the sealing element 5 is mounted onto the carrier element 4 such that elastic dampening elements 51, which are formed in one piece with the sealing element 5 and which are connected by, for example, tabs 513, 514 to the sealing ring 50, are mounted onto the positive-locking elements 43. Each elastic dampening element 51 is in this case formed by webs 510 which are grouped around an opening 515 and which, between them, leave engagement recesses 516 free into which the cheek portions 430 of the positive-locking elements 43 engage. The number of webs 515 per elastic dampening element 51 corresponds to the number of cheek portions 430 per positive-locking element 43. The cheek portions 430 engage in each case between the webs 515 such that each cheek portion 430 is received between exactly two webs 515.

The webs 515 of each elastic dampening element 51 are, at their ends averted from the sealing ring 50, connected to one another by a head portion 512. When the sealing element 5 has been mounted on the carrier element 4, the head portion 512 comes to lie against a face surface 432 of the cylindrical portion 431, as can be seen for example from the sectional view as per FIGS. 16A and 16B.

The elastic dampening elements 51 are, like the sealing element 5 as a whole, manufactured from an elastic material, for example a soft elastomer or a rubber material. The the elastic dampening elements 51, may provide dampening between the drive housing 7 and the carrier element 4 at the positive-locking elements 43, such that vibrations cannot be transmitted, or can be transmitted only in damped fashion, from the drive housing 7 to the carrier element 4.

Figure 18A:
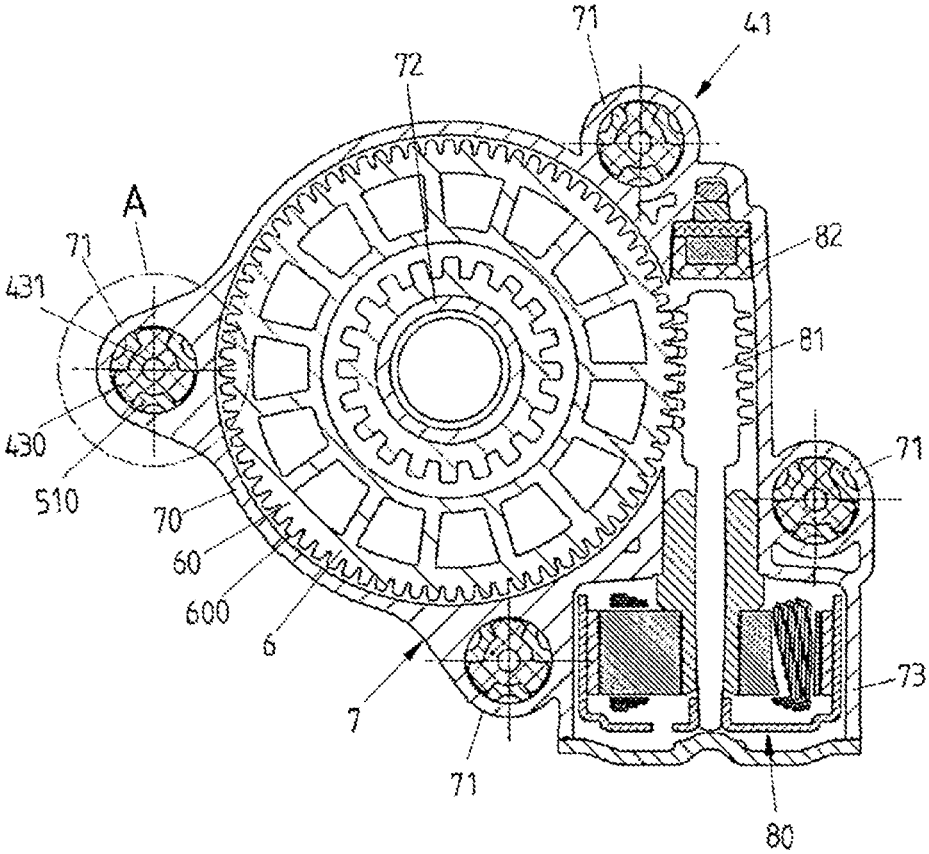
FIG. 18A shows a sectional view along the line E-E as per FIG. 17.
Figure 18B:
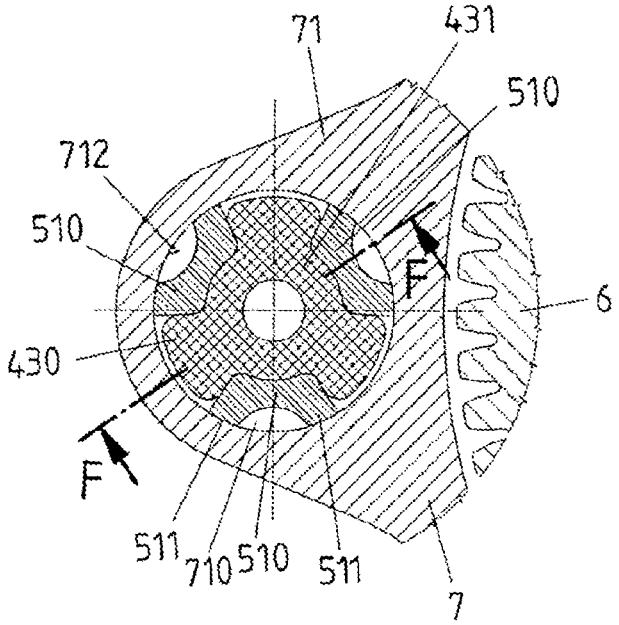
FIG. 18B shows an enlarged view in the detail A as per FIG. 18A.
Figure 18C:
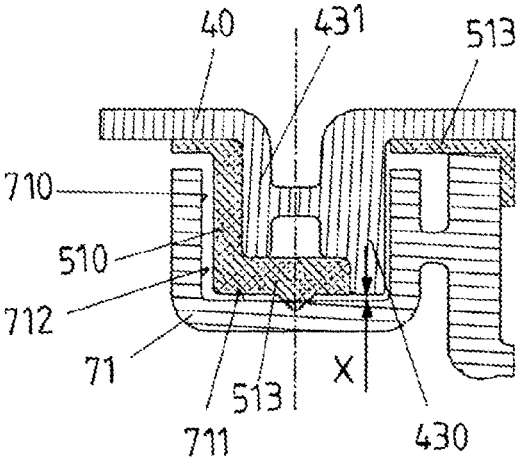
FIG. 18C shows a sectional view along the line F-F as per FIG. 18B.

For this purpose, the webs 515 of each elastic dampening element 51, as can be seen in particular from the cross-sectional view of an elastic dampening element 51 on an associated positive-locking element 43 as per FIG. 18B, protrude radially outward beyond the cheek portions 430 and are in contact with an inner, circumferential shell surface 712 which surrounds the associated positive-locking opening 710 of the positive-locking element 71. The webs 510 may radially support the positive-locking elements 43 so that they may be supported radially relative to the positive-locking element 71, such that, during normal operation, the positive-locking elements 43 interact with the drive housing 7 in an elastically damped manner via the elastic dampening elements 51.

As can be seen from FIG. 18B, a radial play for the positive-locking element 43 within the associated positive-locking opening 710 is set by, for example, the webs 510. Thus, during normal operation, at least in the case of small vibrations, the positive-locking element 43 does not come into contact with the inner shell surface 712 on the positive-locking opening 710, such that an excitation of vibrations on the carrier element 4 is at least dampened.

In the case of relatively large vibrations, the play between the positive-locking element 43 and the inner shell surface 712 may however be overcome, such that contact can occur between at least one of the cheek portions 430 and the inner shell surface 712. In this way, an excessive compression at the webs 510 of the respective elastic dampening element 51 is avoided, such that it is ensured that the elastic characteristics of the elastic dampening elements 51 are maintained over the service life of the drive apparatus 1.

The webs 510 of the elastic dampening element 51 may dampening dampen the excitation of vibrations on the carrier element 4 is effected in particular in a plane transverse with respect to the axis of rotation D, that is to say in the plane of extent of the carrier element 4. In order to additionally also realize dampening dampening of the excitation of vibrations axially with respect to the axis of rotation D, in each case one spacer element 517 in the form of a stud is arranged on the head portions 513 of the elastic dampening dampening elements 51, as can be seen from FIG. 18C, by means of which spacer element a play X between the cheek portions 430 of each positive-locking element 43 and a base 711 of the respectively associated positive-locking opening 710 is provided. Said play X serves in particular for tolerance compensation.

Figure 14:
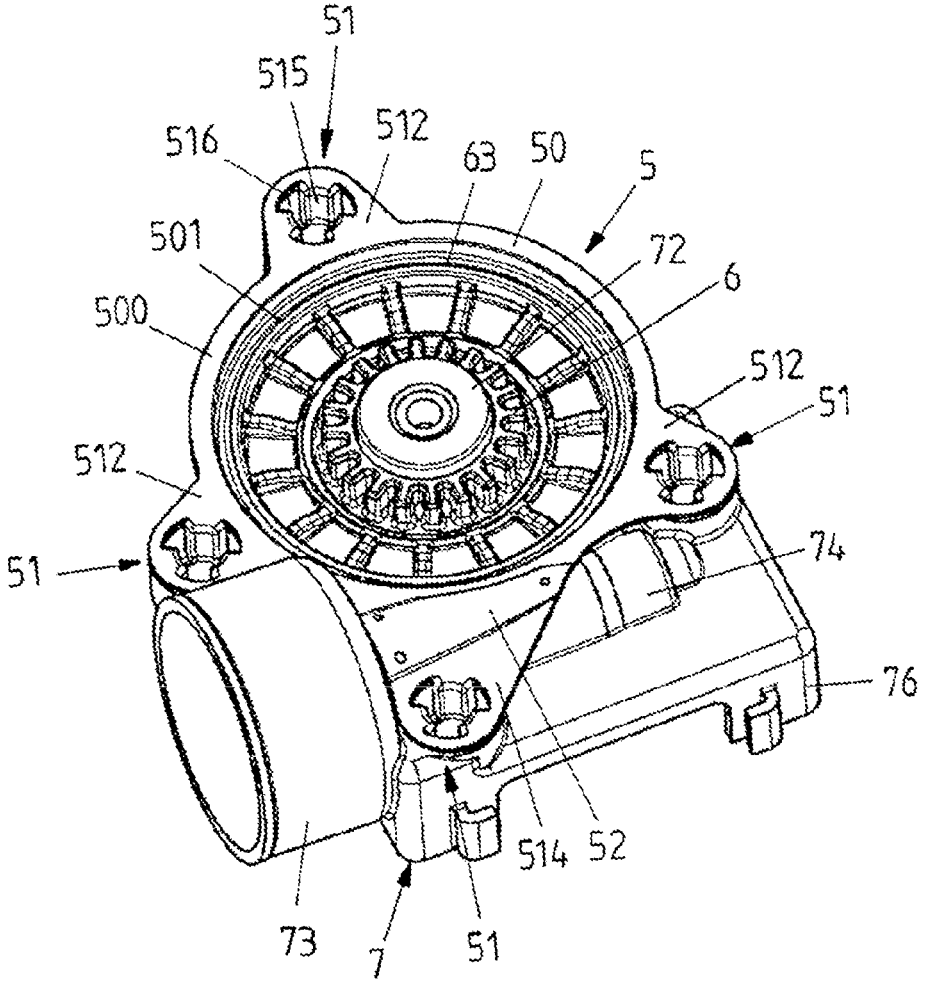
FIG. 14 shows a view of the drive housing with sealing element arranged thereon.
Figure 15:
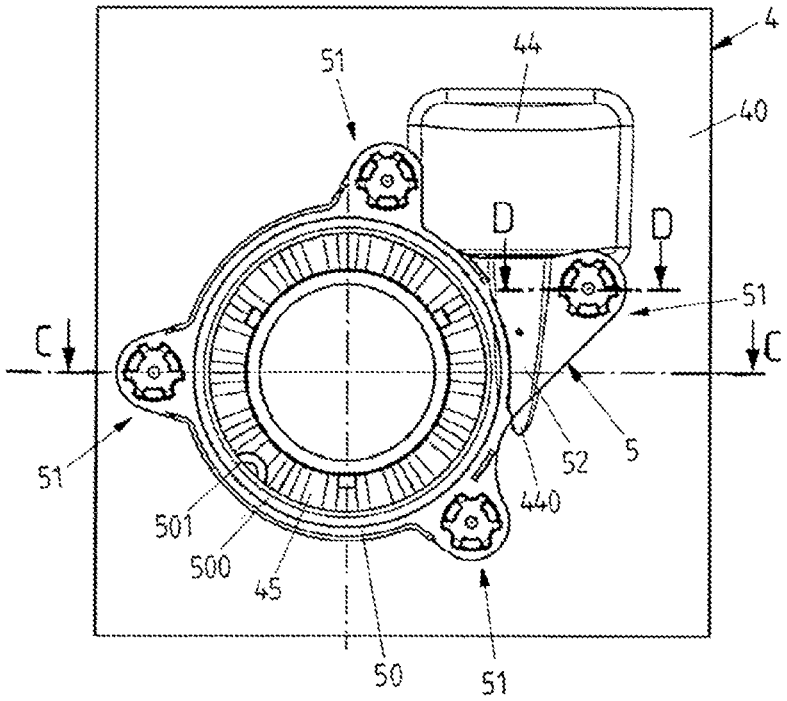
FIG. 15 shows a view of the carrier element from the side facing toward the drive housing.
Figure 16A:
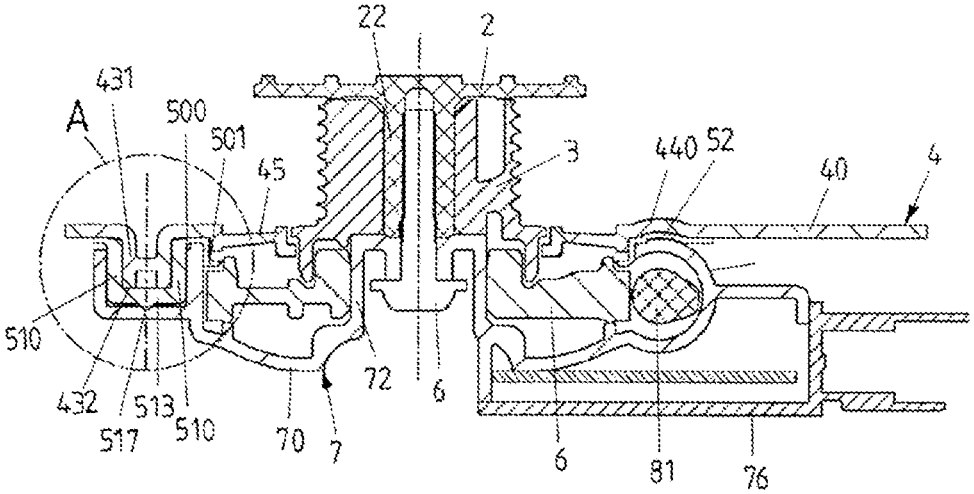
FIG. 16A shows a sectional view along the line C-C as per FIG. 15, with the drive housing mounted onto the carrier element.
Figure 16B:
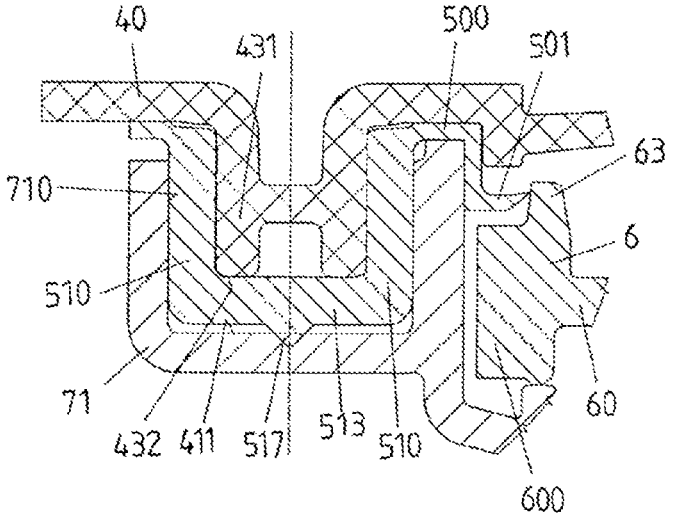
FIG. 16B shows an enlarged view in the detail A as per FIG. 16A.
Figure 16C:
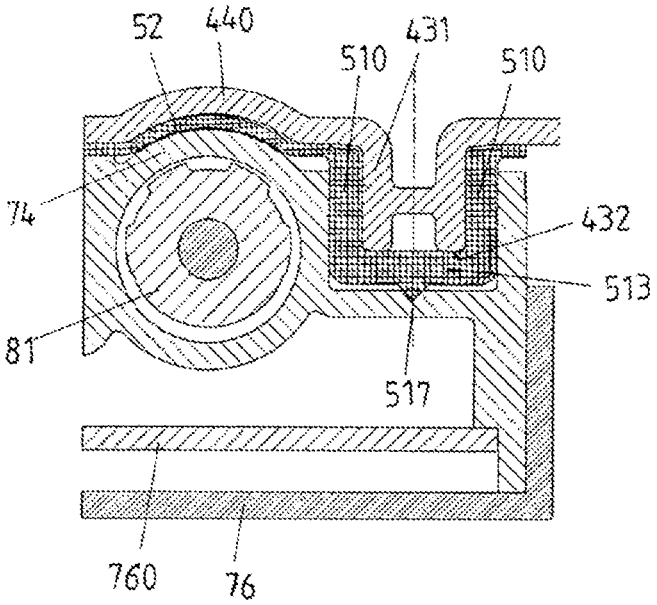
FIG. 16C shows an enlarged sectional view along the line D-D as per FIG. 15.
Figure 17:
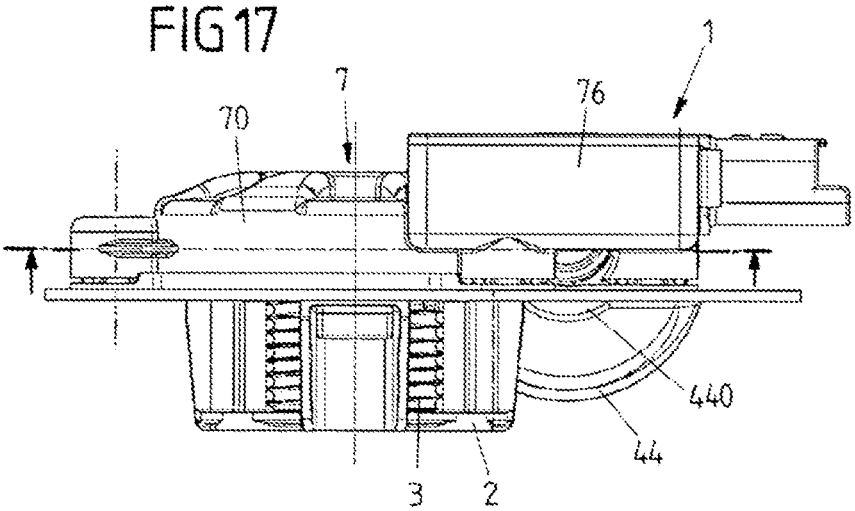
FIG. 17 shows a side view of the drive apparatus.

The sealing element 5 has, on its sealing ring 50, a ring 500 which assumes an encircling intermediate position between the housing pot 70 of the drive housing 7 and the carrier element 4 circumferentially around the central opening 41 on the carrier element 4, as can be seen for example from FIG. 16B viewed together with FIGS. 14, 15 and 16A. Offset axially in the direction of the drive gear 6 within the housing pot 70, and protruding radially with respect to the ring 500, there is formed a sealing lip 501 which produces a sealing transition to the drive gear 6, as illustrated for example in FIG. 16A and in the enlarged view as per FIG. 16B. By means of the sealing element 50, a moisture-tight transition between the carrier element 4 and the drive housing 7 is produced.

On the sealing element 5, there is formed a curved portion 52 which comes to lie in the region of the protuberance 45 for receiving the worm housing 74. The curved portion 52 forms an intermediate layer between the worm housing 74 and the carrier element 4, such that acoustic decoupling of the drive housing 7 from the carrier element 4 is achieved in this way also.

Figure 9:
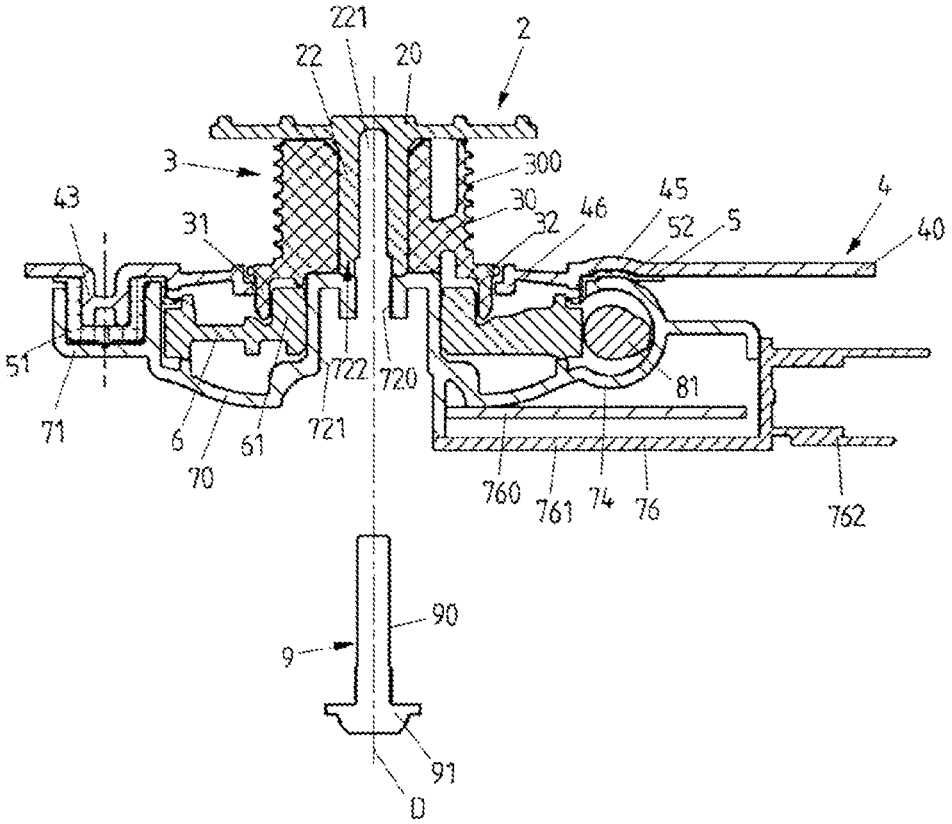
FIG. 9 shows a cross-sectional view along the line B-B as per FIG. 4A, before bracing of the cable exit housing with a drive housing by means of a fastening element.

When the drive housing 7 has been mounted, with the interposition of the sealing element 5, onto the carrier element 4, then the drive housing 7 is braced with the cable exit housing 2 by means of the fastening element 9, such that, in this way, the cable exit housing 2 and the drive housing 7 are fixed relative to one another and to the carrier element 4. As illustrated in FIG. 9, the fastening element 9 is inserted into the engagement opening 721 within the bearing element 72 of the drive housing 7, such that the fastening element 9 engages with a shank 90 through the opening 720 on the head of the bearing element 72 and engages into the opening 221 of the bearing element 22 of the cable exit housing 2. Here, a head 91 of the fastening element 9 comes to lie against that side of the opening 720 which is averted from the bearing element 22, such that, by virtue of the fastening element 9 being screwed into the opening 221 within the bearing element 22, the cable exit housing 2 is braced relative to the drive housing 7.

As can be seen for example from FIGS. 2 and 6, the cable exit housing 2 has, on its base 20 on the side averted from the carrier element 4, structural elements 200, 201 in the form of stiffening ribs, which extend radially with respect to the axis of rotation D created by the bearing element 22 and circumferentially around the axis of rotation D respectively, and which stiffen the base 20. Here, in the radially extending structural elements 200, apertures 202 for material weakening are formed locally on the structural elements 200, which apertures are arranged along a ring around the axis of rotation D and create a predetermined deformation line for the elastic deformation of the base 20.

If the fastening element 9 is screwed into the bearing element 22 from the side of the drive housing 7, then the base 20 can deform at least slightly, such that production-induced tolerances can be compensated and the cable exit housing 2 is, by way of the foot portions 210 on the housing portions 21, fixed without play to the carrier element 4.

On an end averted from the base 20, the bearing element 22 furthermore has a conical portion 220 in the form of a centering cone (see FIGS. 8 and 9), which, when the cable exit housing 2 is braced relative to the drive housing 7, enters into engagement with a complementarily shaped centering engagement means on the bearing element 72 of the drive housing 7, and thereby sets a centered position of the bearing element 22 of the cable exit housing 2 relative to the bearing element 72 of the drive housing 7. Both the conical portion 220 on the end of the bearing element 22 and the centering engagement means 722 on the head of the bearing element 72 are of conical shape and complementary to one another, such that, in a state of engagement, the bearing element 22 of the cable exit housing 2 is oriented in a centered manner relative to the bearing element 72 of the drive housing 7.

The bearing element 22 of the cable exit housing 2 and the bearing element 72 of the drive housing 7 in this case create a common axis of rotation D for the cable drum 3 on one side and the drive gear 6 on the other side, such that the cable drum 3 and the drive gear 6 can, during operation, rotate coaxially with respect to one another and jointly with one another.

The concept on which the solution is based is not restricted to the exemplary embodiments discussed above, but rather may basically also be realized in a very different manner.

A drive apparatus of the type described is in particular not restricted to use on a window lifter, but rather may also serve for adjusting some other adjustable element, for example a sliding roof or the like, in a vehicle.

The drive apparatus can be assembled easily, in particular using one (single) axially bracing fastening element. An assembly process with few assembly steps is realized, which may be simple and expedient with reliable fixing of the cable exit housing and of the drive housing to the carrier element.

LIST OF REFERENCE DESIGNATIONS

1 Drive apparatus
10 Cable
11 Guide rail
110, 111 Diverting means
12 Driver
13 Window pane
2 Cable exit housing
20 Base
200, 201 Structural element (stiffening rib)
202 Aperture (material weakening)
21 Housing portion
210 Foot portion
211 Detent element
212 Positive-locking opening (slot opening)
22 Bearing element (bearing dome)
220 Centering cone
221 Opening
23 Securing element
3 Cable drum
30 Body
300 Cable groove
31 Internal gear
310 Toothing
32 Rest element
4 Carrier element (assembly carrier)
40 Surface portion
41 Opening
42 Positive-locking element
420 Detent recess
43 Positive-locking element
430 Cheek portion (pin)
431 Cylinder portion
432 Face surface
44 Protuberance
440 Protuberance
45 Contact ring
46 Rest ring
5 Sealing element
50 Sealing ring
500 Ring
501 Sealing lip
51 Elastic dampening dampening element
510 Web
511 Contact portion (edge)
512 Head portion
513, 514 Tabs
515 Opening
516 Engagement recess
517 Spacer element (stud)
52 Curved portion
6 Drive gear
60 Body
600 External toothing
61 Connecting gear
610 Toothing
62 Opening
63 Sealing edge
7 Drive housing
70 Housing pot
71 Positive-locking element (engagement bushing)
710 Positive-locking opening
711 Base
712 Inner shell surface
72 Bearing element (bearing dome)
720 Opening
721 Engagement opening
722 Centering engagement
73 Motor pot
74 Worm housing
75 Housing cover

76 Electronics housing
760 Circuit board
761 Housing plate
762 Plug connector
8 Motor unit
80 Electric motor
800 Drive shaft
81 Drive worm
82 Bearing
9 Fastening element
90 Shank
91 Head
D Axis of rotation
X Play

The invention claimed is:

1. A drive apparatus, the drive apparatus comprising:
a carrier element;
a motor unit;
a transmission element configured to be driven by the motor unit; and
a drive housing arranged on the carrier element and including a bearing element for rotatably bearing the transmission element about an axis of rotation;
wherein the carrier element includes at least one first positive-locking element and the drive housing includes at least one second positive-locking element, the at least one first positive-locking element and the at least one second positive-locking element are engaged to one another to provide a rotation-preventing securing action,
wherein an elastic dampening element arranged between the at least one first positive-locking element and the at least one second positive-locking element such that the first positive-locking element and the second positive-locking element are supported in damped fashion relative to one another along at least one spatial direction via the elastic dampening element in a first load state, but come into contact with one another in a second load state, wherein the second load state having a load greater than a load of the first load state,
wherein one of the at least one first positive-locking element and the at least one second positive-locking element includes a positive-locking pin and the other of the at least one first positive-locking element or the at least one second positive-locking element defines a positive-locking opening,
wherein the positive-locking pin includes a central portion, and the elastic dampening element is arranged on the central portion.

2. The drive apparatus as claimed in claim 1, wherein the positive-locking pin includes at least one cheek portion extending parallel to the axis of rotation and protruding radially from the central portion, wherein the elastic dampening element includes at least one elastic web, wherein the at least one cheek portion and the at least one elastic web extend adjacent to one another on the central portion.

3. The drive apparatus as claimed in claim 2, wherein the at least one elastic web protrudes radially with respect to the at least one cheek portion.

4. The drive apparatus as claimed in claim 2, wherein to set an elastic play of the positive-locking pin in the positive-locking opening, the at least one elastic web bears against a shell surface which circumferentially surrounds the positive-locking opening.

5. The drive apparatus as claimed in claim 1, wherein the positive-locking pin includes multiple cheek portions distributed circumferentially about the central portion, and the elastic dampening element including multiple webs, wherein each cheek portion is arranged between a pair of webs.

6. The drive apparatus as claimed in claim 1, wherein the elastic dampening element includes a head portion overlapping the central portion at a face surface extending transversely with respect to the axis of rotation.

7. The drive apparatus as claimed in claim 6, wherein at least one spacer element for providing tolerance compensation between the positive-locking pin and a base of the positive-locking opening is arranged on the head portion.

8. The drive apparatus as claimed in claim 1, further comprising a sealing ring formed in one piece with the at least one elastic dampening element, the sealing ring being configured to seal off a transition between the carrier element and the drive housing in moisture-tight fashion.

9. A drive apparatus, the drive apparatus comprising:
a carrier element;
a motor unit;
a transmission element configured to be driven by said motor unit; and
a drive housing arranged on the carrier element and including a first bearing element for rotatably bearing the transmission element about an axis of rotation;
wherein the carrier element includes at least one first positive-locking element and the drive housing includes at least one second positive-locking element, the at least one first positive-locking element and the at least one second positive-locking element being in engagement with one another for a rotation-preventing securing action,
wherein an elastic dampening element is arranged between the at least one first positive-locking element and the at least one second positive-locking element and acts such that the first positive-locking element and the second positive-locking element are supported in damped fashion relative to one another along at least one spatial direction via the elastic dampening element in a first load state, but come into contact with one another in a second load state associated with a larger load than the first load state,
wherein the drive apparatus includes a cable drum and a cable exit housing arranged on a side of the carrier element facing away from the drive housing, wherein the cable exit housing includes a second bearing element for rotatably bearing the cable drum about the axis of rotation.

10. The drive apparatus as claimed in claim 9, wherein the cable exit housing and the drive housing are fastened to one another by a fastening element acting between the second bearing element of the cable exit housing and the first bearing element of the drive housing.

11. The drive apparatus as claimed in claim 10, wherein the fastening element is formed by a screw element bracing the cable exit housing and the drive housing relative to one another axially along the axis of rotation.

12. The drive apparatus as claimed in claim 10, wherein the fastening element extends through an opening of one of the first bearing element and the second bearing element and engages with the other of the first bearing element and the second bearing element.

13. The drive apparatus as claimed in claim 10, wherein the cable exit housing includes at least one housing portion which is spaced apart radially from the second bearing element of the cable exit housing and which is fixed to the carrier element such that the cable exit housing is held rotationally fixedly on the carrier element with respect to the axis of rotation.

14. The drive apparatus as claimed in claim 13, wherein the housing portion includes a foot portion mounted onto the carrier element, wherein a positive-locking element on the foot portion or on the carrier element engages in positively locking fashion into a positive-locking opening formed by the other of the foot portion or the carrier element.

15. A drive for a power window actuator, the drive comprising:

a carrier including a first positive-locking element;

a transmission element configured to be driven by a motor;

a drive housing arranged on the carrier and including a bearing element, configured to engage the transmission element such that the transmission element is rotatable about a rotational axis, and a second positive-locking element; and an elastic dampening element disposed between the first positive-locking element and the second positive locking element, wherein the first positive-locking element is a pin and the second positive-locking element defines an opening configured to receive the pin and the elastic dampening element.

16. The drive of claim 15, wherein the elastic dampening element is U-shaped in a cross-section.

* * * * *